US005909835A

United States Patent [19]

Zanette

[11] Patent Number: 5,909,835

[45] Date of Patent: Jun. 8, 1999

[54] GRIPPER FEEDER FOR METAL STRIP

[75] Inventor: Donato Zanette, Maserada Sul Piave, Italy

[73] Assignee: Dalcos S.R.L., Italy

[21] Appl. No.: 08/628,633

[22] PCT Filed: Jul. 6, 1994

[86] PCT No.: PCT/EP94/02214

§ 371 Date: Apr. 16, 1996

§ 102(e) Date: Apr. 16, 1996

[87] PCT Pub. No.: WO95/17984

PCT Pub. Date: Jul. 6, 1995

[30] Foreign Application Priority Data

Dec. 30, 1993 [IT] Italy ..... VE93A0039

[51] Int. Cl.[6] ..... B65H 20/24; B65H 23/06; F16H 1/18

[52] U.S. Cl. ..... 226/112; 226/149; 74/424.8 B

[58] Field of Search ..... 226/112, 149, 226/150; 74/424.8 B, 89.15

[56] References Cited

U.S. PATENT DOCUMENTS

| | | | |
|---|---|---|---|
| 3,583,268 | 6/1971 | Scribner | 226/112 |
| 4,513,899 | 4/1985 | Ledgerwood | 226/150 |
| 4,558,809 | 12/1985 | Schoen | 226/150 |
| 4,577,483 | 3/1986 | Rehag et al. | 226/112 |
| 4,577,791 | 3/1986 | Leinhaas | 226/150 |
| 4,580,710 | 4/1986 | Ledgerwood | 226/150 |
| 5,505,360 | 4/1996 | Giusto | 226/150 |

FOREIGN PATENT DOCUMENTS

| | | | |
|---|---|---|---|
| 0282264 | 9/1988 | European Pat. Off. . | |
| 0321602 | 6/1989 | European Pat. Off. . | |
| 0487456 | 5/1992 | European Pat. Off. . | |
| 2683012 | 4/1993 | France | 74/424.8 B |
| 1811302 | 10/1969 | Germany . | |
| 58-058948 | 4/1983 | Japan . | |
| 2041814 | 9/1980 | United Kingdom . | |

*Primary Examiner*—Charles A. Marmor
*Assistant Examiner*—Matthew A. Kaness
*Attorney, Agent, or Firm*—Hoffman, Wasson & Gitler

[57] ABSTRACT

A gripper feeder for metal strip including on a base one pair of grippers for an engagement of a metal strip to be advanced; members for moving said grippers in a direction parallel to an axis of the strip and in the opposite direction; and means for independently operating the grippers such that the gripper which moves in the direction of advancement of the strip is activated, whereas that which moves in an opposite direction is deactivated.

10 Claims, 3 Drawing Sheets

GRIPPER FEEDER FOR METAL STRIP

FIELD OF THE INVENTION

This invention relates to a gripper feeder for metal strip.

DESCRIPTION OF THE PRIOR ART

Metal strip feeders are known for presses and machines in general in which the strip is subjected to particular operations as required.

A known type of feeder of pneumatic operation uses two clamps acting transversely on the strip to be conveyed. One of these clamps is fixed, while the other is driven with reciprocating movement in a direction parallel to the longitudinal axis of the strip. In operation, the two clamps are operated alternately in a synchronized manner in the sense that when the fixed clamp is open the mobile clamp is closed onto the strip to advance it, whereas on termination of the advancement stroke of the mobile clamp the fixed clamp is closed and, after being opened, the mobile clamp is returned backwards to grip the metal strip further upstream and then advance it through a further distance when the fixed clamp is reopened.

A drawback of this known feeder is that it is non-continuous and does not enable high operating speeds to be achieved.

A further drawback is that it is extremely rigid, in the sense that it requires laborious manual action each time the advancement pitch of the metal strip is to be modified.

A further drawback is that as it moves the metal strip by thrusting, it cannot be used for very thin strip.

A further drawback is that it occupies the entire surface of the strip to be conveyed and does not allow it to be operated upon in that part engaged by the feeder.

A further drawback is that it has a transverse dimension greater than the width of the strip, and for certain strip widths this dimension becomes excessive.

A further drawback is that it cannot produce an advancement pitch greater than certain length.

A roller feeder is also known comprising at least one pair of counter-rotating rollers between which the metal strip to be advanced is interposed. It substantially overcomes the drawbacks of known pneumatic feeders, and in particular is of continuous programmable operation. However it has other drawbacks, and in particular:

- it engages the entire metal strip and therefore does not enable it to be subjected to other operations during the gripping;
- it maintains the strip constantly engaged, and if this is curved in the horizontal plane or is inserted incorrectly into the feeder, transverse stresses of a progressively increasing extent arise and can be eliminated only by periodically slackening the grip between the rollers;
- if the strip advancement is controlled by acting on the rollers, errors can arise because of the inevitable slippage between the rollers and the strip; if however it is controlled by acting on the strip itself these errors are not present, but the feeder then has a low advancement speed because of the need to correct errors deriving from inevitable slippage.

Mechanical feeders with grippers controlled by the power machine positioned downstream of them are also known. In this case the grippers are driven with reciprocating movement and are reliable and fast. However they are extremely rigid in their performance and involve slow and difficult adjustment, which can be effected only by specialized personnel. EP-A-4874456 describes a method and device for advancing a band, in which the stepwise transport of the band is performed by two grippers which are moved backwards and forward synchronously, each in their longitudinal direction by a common drive.

BRIEF DESCRIPTION OF THE INVENTION

The object of the invention is to provide a feeder:

- which is sustantially continuous;
- which does not engage the entire surface of the metal strip and therefore enables it to be subjected to operations during its conveying;
- which is fast;
- which is programmable;
- which is free from errors.

All these objects and further ones are attained according to the invention through a gripper feeder for metal strip comprising on a base:

- at least one pair of grippers for the engagement of the metal strip to be advanced;
- members for moving said grippers in a direction parallel to the axis of said strip and in the opposite direction; and
- means for independently operating said grippers such that the gripper which moves in the direction of advancement of the strip is activated, whereas that which moves in the opposite direction is deactivated, said members for moving said grippers consisting of a rod engaged with a threaded bush provided on the grippers, and rotated by a single electric motor powered alternately in the two directions of rotation characterized in that said rod has two portions threaded in opposite directions.

BRIEF DESCRIPTION OF THE DRAWINGS

Two preferred embodiments of the present invention are further described hereinafter by way of non-limiting example with reference to the accompanying drawings, in which.

DESCRIPTION OF PREFERRED EMBODIMENTS

Figure 1:
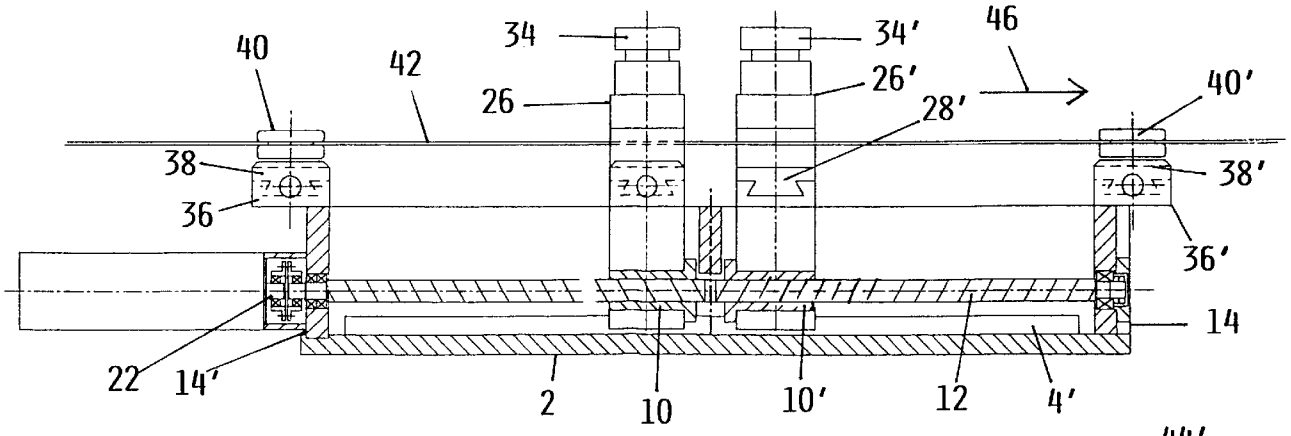
FIG. 1 is a longitudinal section of a first embodiment of a gripper feeder according to the invention.
Figure 3:
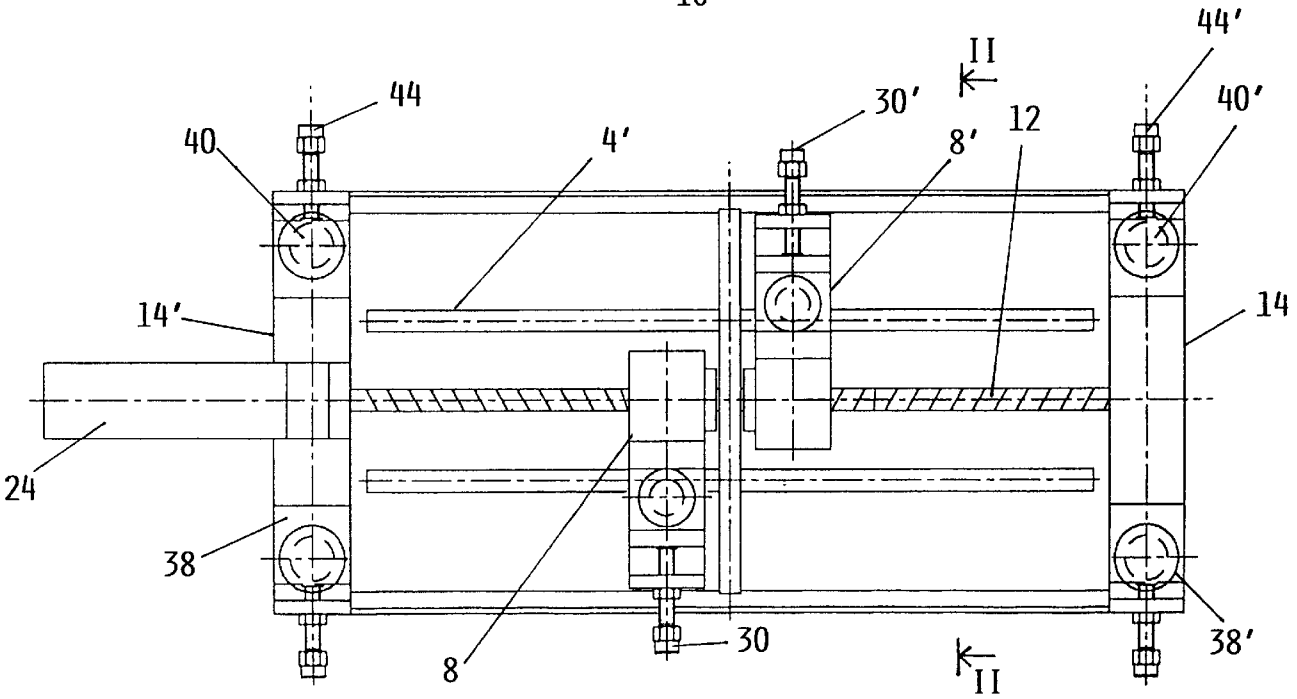
FIG. 3 is a plan view thereof.
Figure 2:
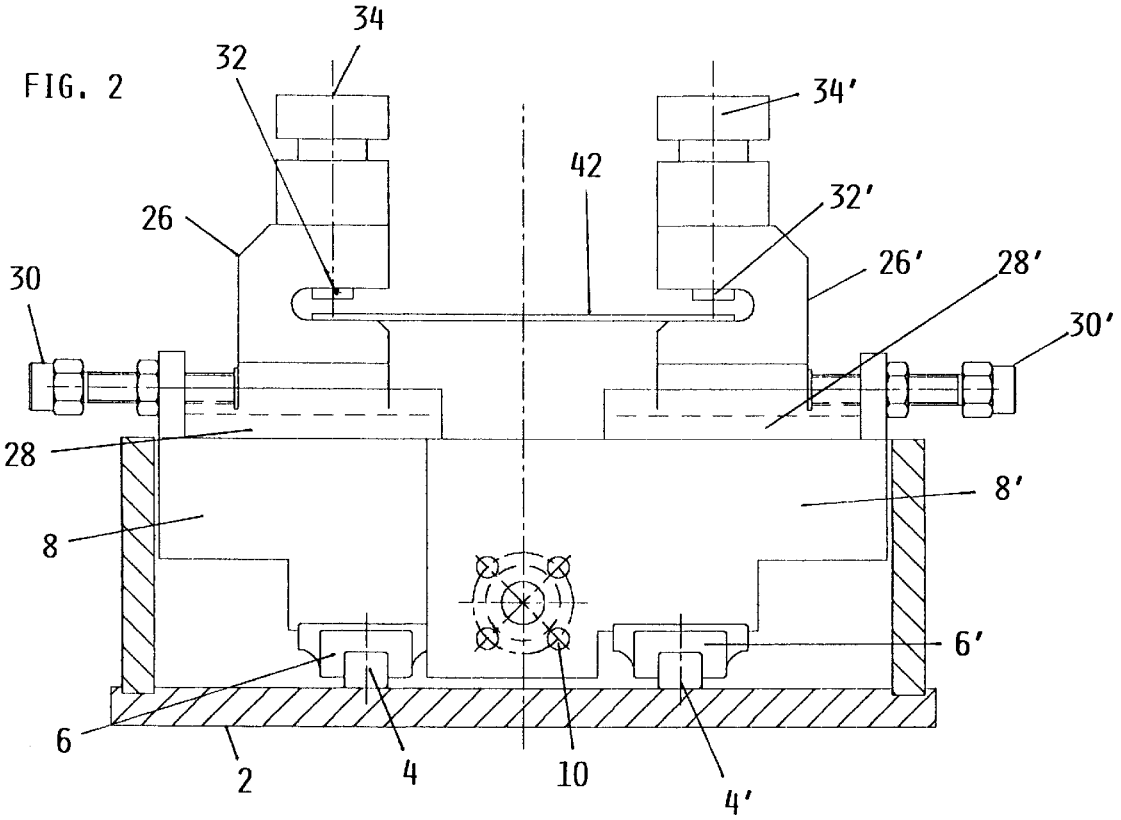
FIG. 2 is an enlarged cross-section therethrough on the line II—II of FIG. 3.

As can be seen from the drawings, the gripper feeder for metal strip according to the invention comprises, in the embodiment shown in FIGS. 1 to 3, a base 2 on which there are mounted two longitudinal rails 4,4' for guiding two slides 6,6' on which two carriages 8,8' are mounted. Each of the carriages 8,8' is provided with a threaded bush 10,10' in which there engages a threaded rod 12, provided with two portions threaded in opposite directions.

The threaded rod 12, is supported by a pair of supports 14,14' fixed to the base 2. Specifically, each rod 12, is supported by the support 14 exactly at its right hand end with reference to FIGS. 1 and 3, whereas it extends beyond the support 14' at its left hand end, to engage the exit shaft 22 of a direct current electric motor 24 mounted on the base 2.

Each carriage 8,8' supports a gripper 26,26' which is slidable along a dovetail rail 28,28' arranged transversely, ie perpendicular to the axis of the threaded rods 12, and of which the movements are controlled by a respective mechanical actuator 30,30'.

Each gripper 26,26' comprises a fixed jaw rigid with the slide slidable along the corresponding rail 28,28', and a movable jaw 32,32' driven relative to the fixed jaw by a pneumatic actuator 34,34' of vertical axis.

On the supports 14,14' for the threaded rods 12, there are also mounted transverse dovetail guides 36,36' along which there slide pairs of carriages 38,38' supporting rollers 40,40' of vertical axis with their lateral surface comprising a groove for engaging and guiding the longitudinal edge of the metal strip 42 to be advanced.

The carriages 38,38' are driven along the respective guides 36,36' by mechanical actuators 44,44'.

The operation of this first embodiment of the feeder according to the invention is as follows:

an adjustment is firstly made to adapt the machine to the width of the strip 42 to be fed; this adjustment requires operating the actuators 30,30' which adjust the distance between the grippers 26,26', and then the actuators 44,44' which adjust the distance between the guide rollers 40,40' of each pair.

Having made this preliminary adjustment, the machine is ready to operate. The electric motor 24 is powered to rotate in one of the two directions of rotation, with the result that because of the particular coupling between this latter and the two threaded rods 12, this is rotated in the same direction. However, as their threads are in opposite directions, its rotation causes the two carriages 8,8' to slide in the opposite direction along the respective rails 4,4', with consequent sliding in the opposite direction of the two grippers 26,26' mounted on said carriages. At the same time an activation command is fed to the gripper 26, which during this stage moves in the same direction as the predetermined direction of advancement of the metal strip 42, indicated by the arrow 46 in the drawings, and a deactivation command is fed to the gripper 26' which moves in the opposite direction.

When the gripper 26 has practically reached its front end-of-travel position along the respective guide 4 and the gripper 26' has reached its rear end-of-travel position along the respective guide 4', the direction of rotation of the electric motor 24 is reversed while at the same time a deactivation command is fed to the actuator 34 of the gripper 26 and a deactivation command is fed to the actuatore 34' of the gripper 26', so that also in this case the gripper which moves in the same direction as the predetermined direction of advancement of the metal strip 42 grips said strip and the gripper which moves in the opposite direction disengages from it.

This alternation in the direction of rotation of the motor 24 and the alternation in the activation commands for the two grippers results in unidirectional advancement of the metal strip 42, this advancement having an intermittency which can be made to approach continuity by suitably controlling the various intervention times.

From the aforegoing it is apparent that the gripper feeder according to the invention is considerably more advantageous than conventional feeders, and in particular:

it grips the strip only along a longitudinal edge thereof, this on the one hand leaving the remainder of the strip free for possible operations and on the other hand resulting in a small overall size independent of the strip width;

it grips the strip at successive points, so allowing any incorrect dragging due to strip curving or to incorrect insertion into the feeder to be corrected;

it provides effective guide action for the strip along both edges;

it ensures reliable gripping of the metal strip 42 without any slippage between this and the grippers, so ensuring its correct advancement by controlling the motor 24 which operates the threaded rods 12,12'; in this manner, electronic and hence programmable advancement control is made possible in a like manner to conventional electronic roller feeders, while at the same time mechanical and hence slippage-free gripping is provided in a like manner to mechanical or pneumatic feeders.

Figure 5:
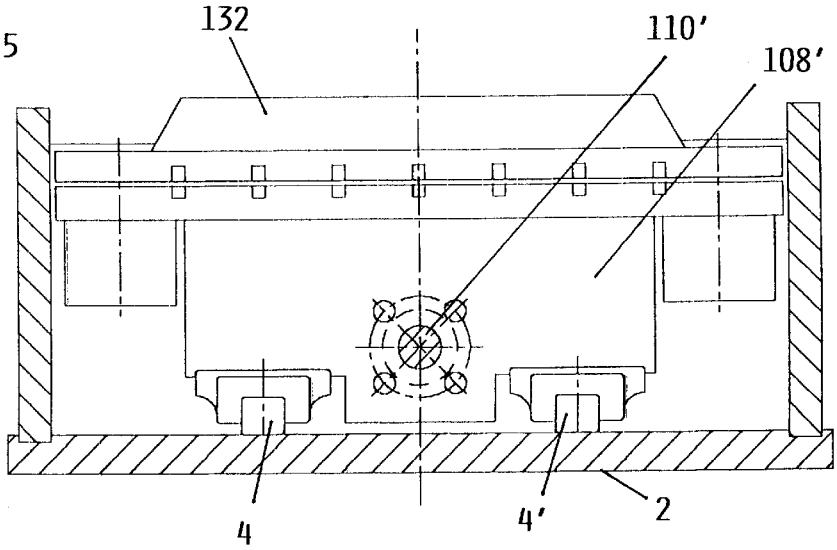
FIG. 5 is an enlarged cross-section therethrough on the line V—V of FIG. 5.
Figure 4:
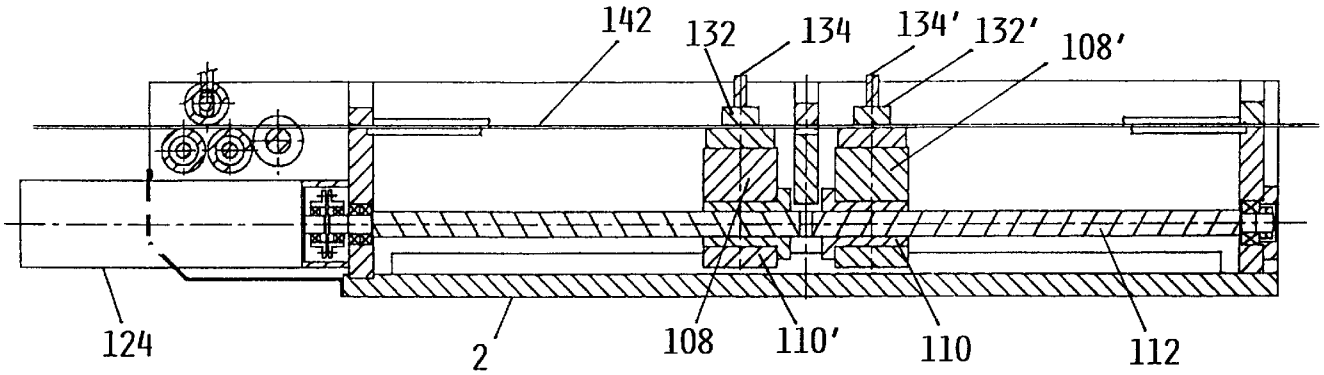
FIG. 4 is a longitudinal section of a second embodiment thereof.
Figure 6:
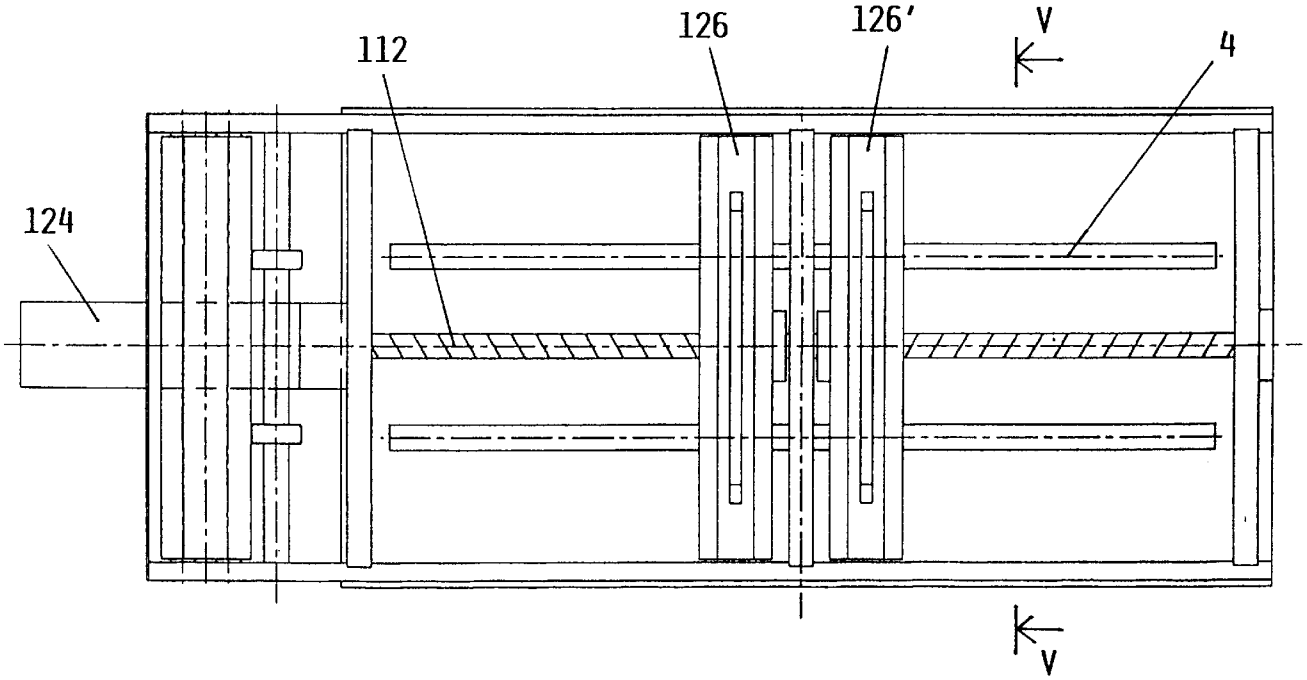
FIG. 6 is a plan view.

In the embodiment shown in FIGS. 4 to 6, two transverse grippers 126, 126' are provided acting on the entire length of the metal strip 142. The lower jaw of each gripper 126, 126' lowerly protrudes in a carriage 108, 108' provided with a threaded bush 110, 110' in which there engages a threaded rod 112 realized in two portions threaded in opposite directions.

The threaded rod is driven, as in the embodiment of FIGS. 1–3, by a direct current electric motor 124.

Each gripper comprises a fixed jaw rigid with the carriage and a movable jaw 123, 123' driven relative to the fixed jaw by pneumatic actuator 134,134' of vertica axis.

It being understood that the general principle of gripping the metal strip by a gripper which is kept engaged during the working stroke and opened during the return stroke, it is obvious that, due to the opposite threads of the rods 112, while a gripper 126,126' carries out the working stroke, the other gripper 126',126 carries out the return stroke.

This embodiment enables to obtain a more reliable operative precision since the operating obtained through one threaded rod eliminates the possible plays.

Furthermore the entire width shaped gripper enables to be adapted to metal strip of different width without however laterally adjusting the position of the grippers.

I claim:

1. A gripper feeder for a metal strip comprising:

a base;

guide means for guiding at least one pair of carriages slidable along said guide means;

a gripper mounted on each carriage of said at least one pair of carriages, for engagement of said metal strip to be moved;

members for moving said gripper in a first direction of movement parallel to a longitudinal axis of said strip and in a second direction of movement opposite to said first direction;

means for independently operating said gripper of said at least one pair of carriages such that when said gripper of one of said at least one pair of carriages moves in said first direction of movement of said strip and is activated, a gripper of a second carriage of said at least one pair carriages moves in said second opposite direction and is deactivated, said members for moving said at least one pair of carriages includes a single threaded rod and a single electric motor, which rotates said threaded rod, said motor being powered alternately in said first and second directions, wherein said rod has a first portion and a second portion threaded in opposite directions, a threaded bush provided on one carriage of said at least one pair of carriages engaging said first portion and a threaded bush provided in said second carriage of said at least one pair of carriages engaging said second portion.

2. A feeder as claimed in claim 1 wherein said gripper of said at least one pair of carriages is positioned on both sides of said metal strip.

3. A feeder as claimed in claim 1 wherein said gripper of said at least one pair of carriages extends at least for an entire width of said strip.

4. A feeder as claimed in claim 1 wherein said gripper comprises a fixed part rigid with said respective carriage and a movable part operated by an actuator.

5. A feeder as claimed in claim 1 wherein said gripper is mounted on a slide slidable along a horizontal guide rail arranged perpendicular to said axis of said metal strip.

6. A feeder as claimed in claim 5, wherein an actuator is associated with said gripper for moving said gripper along said respective guide rail.

7. A feeder as claimed in claim 1, wherein on said base there are applied pairs of rollers of vertical axis having in their lateral surface a circumferential groove for engaging and guiding a corresponding longitudinal edge of said metal strip.

8. A feeder as claimed in claim 7 wherein at least one roller of each pair is movable relative to said base in a direction perpendicular to said axis of said metal strip.

9. A feeder as claimed in claim 8, wherein said two rollers of each pair are mounted on slides movable along a guide rail arranged perpendicular to said axis of said metal strip on supports rigid with said base.

10. A feeder as claimed in claim 9, wherein an actuator is interposed between said slide of each guide roller and said respective support.

* * * * *